United States Patent [19]

Hollyday et al.

[11] 4,214,800

[45] Jul. 29, 1980

[54] LATCHING-EJECTOR DEVICE

[75] Inventors: Robert D. Hollyday, Elizabethtown; Wayne E. McKinnon, Landisville, both of Pa.

[73] Assignee: AMP Incorporated, Harrisburg, Pa.

[21] Appl. No.: 1,646

[22] Filed: Jan. 8, 1979

[51] Int. Cl.[2] ..... H01R 13/62

[52] U.S. Cl. ..... 339/45 M

[58] Field of Search ..... 339/45, 46

[56] References Cited

U.S. PATENT DOCUMENTS

| | | | |
|---|---|---|---|
| 3,150,906 | 9/1964 | Chambon et al. | 339/45 M |
| 3,451,034 | 6/1969 | Beale | 339/45 R |
| 3,952,232 | 4/1976 | Coules | 339/45 M |

*Primary Examiner*—Joseph H. McGlynn

*Attorney, Agent, or Firm*—Richard B. O'Planick

[57] ABSTRACT

A latching-ejector device is disclosed for intended use with a connector receptacle housing having a base and sidewalls for receiving a plug housing therebetween, and having at least two apertures in opposing sidewalls of the receptacle. The latching-ejector device comprises a generally W-shaped portion having two leg members integral with and depending therefrom for mounting onto the receptacle housing outside of the sidewalls. The W-shaped portion provides a locking lip for intended engagement with an upper surface of the plug housing, and each leg member includes a stud portion projecting through a respective aperture into supporting engagement with a bottom surface of the plug housing. In response to an outward rotation of the W-shaped portion, the locking lip is first disengaged from the upper surface of the plug housing and as continued rotation takes place the stud portions are adapted to swing upward within the apertures forcing the plug housing upward and out of mating relationship with the receptacle housing.

6 Claims, 5 Drawing Figures

LATCHING-EJECTOR DEVICE

BACKGROUND OF THE INVENTION

1. The Field of the Invention

This invention relates to latching-ejector devices of the type used with electrical connector plug and receptacle housings for locking the connector housings together in mating relationship and for ejecting them apart.

2. The Prior Art

For many electrical interconnection applications, an electrical connector is needed having the capability of self latching the plug and receptacle components of the connector together in mating relationship when a mated connector is appropriate, and the versatility for self-ejecting the housings apart when unmating of the electrical contacts therein is desired. Conversely, in many interconnection applications, particularly those which are substantially permanent in nature or those in which connector cost is a critical concern, a connector having the above capability is not needed and use thereof would constitute a costly engineering over-design.

Accordingly, the electrical industry has been in need of an electrical connector which selectively can, but need not, have latching-ejector capability depending on the requirements of the customer and the needs of a particular application. Achievement of a suitable interconnection device has been illusive because of added demands placed upon any proposed connector embodiment. The connector must have the above described versatility yet be relatively inexpensive to produce. Also, the total outside dimensions of a connector in many applications must be kept to a minimum, and the connector must be capable of manual assembly and operation.

Heretofore, no connector assembly had been attained which could optionally offer the above set forth latching-ejector capability and still comply with the size, cost, and performance constraints. U.S. Pat. No. 4,070,081 discloses one approach to the problem and accordingly teaches an electrical connector having latching-ejector means permanently provided at opposite ends of the connector receptacle housing. The latching-ejection function is served by two rocker members rotatably and permanently mounted on respective shafts manufactured within the connector receptacle. While this approach works well and has been well received by the industry, certain problems attendent upon its use prevent it from representing an ideal solution to the needs of the industry. As previously mentioned, some applications do not require latching-ejection capability in the connector, and use of a connector permanently providing this feature can be unnecessarily costly. Also, providing a connector with permanent latching-ejection means considerably complicates the manufacture thereof which adds further to the cost of the resulting connector.

SUMMARY OF THE INVENTION

The subject invention comprises a latching-ejector device intended for use with a connector receptacle of the type having a base and sidewalls defining a channel for receiving an elongated plug housing therein, and having at least two appropriately configured apertures in opposing sidewalls of the receptacle. The latching-ejector device is of a snap-on design with two resilient and parallel leg members depending from a central portion into straddling mounting engagement with the receptacle housing outside the receptacle sidewalls. The central portion provides an outwardly projecting lip, and each leg member has a stud portion projecting through a corresponding aperture and rotatable therein to swing the locking lip into and out of locking engagement with the plug housing. Each stud portion further engages the plug housing in the channel and rotates upward in its aperture to force the receptacle and plug housings apart. The central portion of each latching-ejector device is also adapted to facilitate positive sequential unlocking and ejecting separation of the connector housings.

Accordingly, it is an object of the subject invention to provide a connector assembly having optional latching-ejector capability.

It is a further object of the subject invention to provide a connector assembly having latching-ejector means adapted to snap onto a receptacle housing.

A still further object of the subject invention is to provide a connector assembly having latching-ejector means for effecting sequential unlatching and ejecting separation of plug and receptacle housings.

A still further object of the subject invention is to provide a connector assembly having latching-ejector means which is manually actuated.

Still a further object of the subject invention is to provide a connector assembly including latching-ejector means which can be economically and readily produced.

Accordingly, these and other objects which will be apparent to one skilled in the art are achieved by a preferred embodiment of the instant invention which is described in detail below and illustrated in the accompanying drawings.

DETAILED DESCRIPTION OF THE PREFERRED EMBODIMENT

Figure 1:
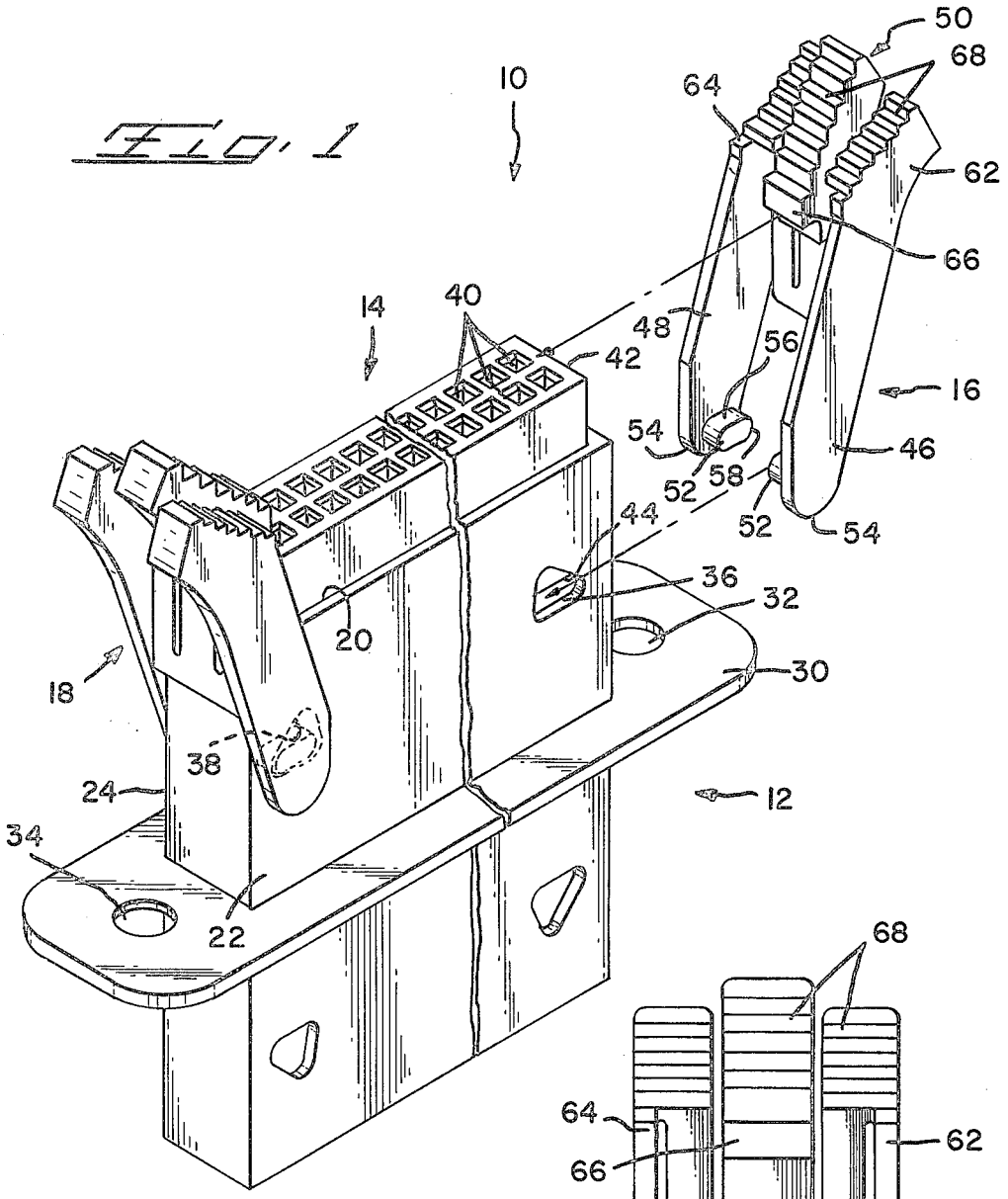
FIG. 1 is a partially exploded perspective view of the subject connector assembly.
Figures 3, 4, 5:
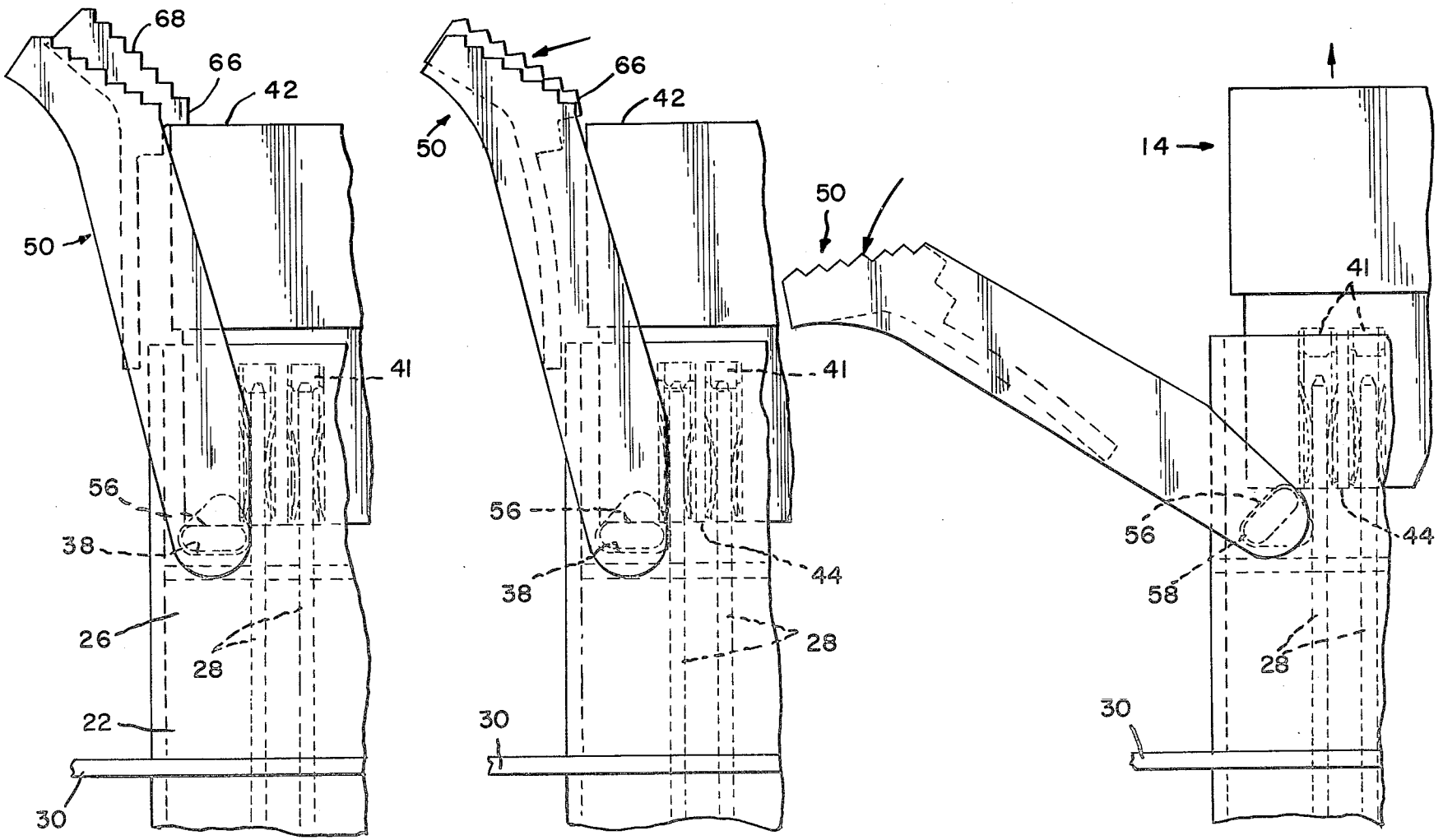
FIG. 3 is a side elevation view of the subject connector assembly of FIG. 1 in the mated and latched position.
FIG. 4 is a side elevation view of the subject connector assembly of FIG. 1 at the beginning of the ejection sequence.
FIG. 5 is a side elevation view of the subject connector assembly of FIG. 1 at the end of the ejection sequence.

Referring first to FIGS. 1 and 3, the subject electrical connector assembly 10 is shown to generally comprise a receptacle housing 12, a plug housing 14, and a pair of identical latching-ejector units 16, 18. The receptacle housing 12 has an elongate channel 20 therein defined by two parallel and spaced apart sidewalls 22, 24 and a base 26. First contact members 28, illustratively shown in phantom to be pins in FIG. 3, are secured in the base 26 in communication with the channel 20. As shown best by FIG. 1, the receptacle housing 12 is provided with a peripheral flange 30 therearound having holes 32, 34 at opposite ends for fixedly mounting the receptacle housing to a panel or the like (not shown). Two pairs of apertures 36, 38, having a predetermined configuration to be described in greater detail below, are formed in oppositely facing sidewalls 22, 24 proximate the ends thereof.

While only the upper portion of the housing receptacle 14 is illustrated in FIGS. 1, 3, 4, 5 as having the subject latching-ejector capability, it is within the contemplation of the subject invention that the lower portion of the housing receptacle 14, below the flange 30, could also be identically adapted with complementarily apertured sidewalls (shown in phantom by FIG. 1) if so desired. The receptacle 12 could then accept mounting engagement of two additional latching-ejector units and mating insertion of a second plug housing from a bottom side. Accordingly, the contact members 28 could be adapted as illustrated in phantom by FIGS. 3, 4, 5 to extend downward through the receptacle housing 12.

With continuing reference to FIGS. 1 and 3, the plug housing 14 has a plurality of contact receiving cavities 40 with socket contacts 41 shown in phantom by FIG. 3 therein adapted to mate with the receptacle pin contacts 28. Although the subject connector is illustratively shown as having pin and socket contact means, it should be appreciated that for the purposes of the subject invention other contacting means would suffice. The plug housing 14 further has a generally rectangular top surface 42 and a bottom surface 44.

Figure 2:
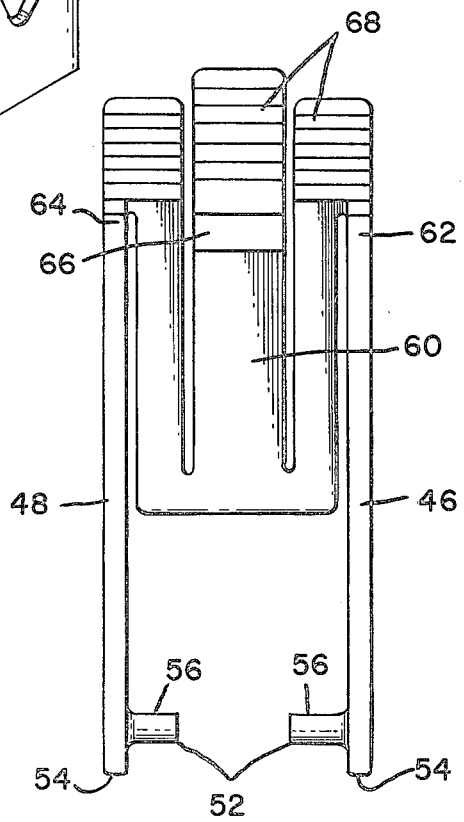
FIG. 2 is a frontal view of the latching-ejector device.

Referring now to FIGS. 1 and 2, the latching-ejector units 16, 18 are shown to comprise a pair of resilient parallel leg members 46, 48 depending from a W-shaped central portion 50. Each leg member provides an inwardly directed stud 52 at a lower end 54 thereof which is transversely elongate and which has an upper longitudinal surface 56 and one end 58; the one end 58 being hereinafter referred to as the pivot end 58. Continuing, the W-shaped portion 50 comprises a central cantilever finger 60 integrally connected to outer fingers 62, 64 which are integral with respective leg members 46, 48. The axis of the center cantilever finger 60 is disposed forward and in advance of the plane in which the axes of the outer fingers 62, 64 lie for a purpose to be explained below, and the cantilever finger 60 is provided with an outwardly directed locking lip 66 which is generally parallel to the transverse axis of the studs 52. As shown, the upper surface portions of the fingers 60, 62, 64 are inclined upward and have grooves 68 thereacross to aid in the establishment of positive digital contact thereagainst.

Assembly of the subject invention procedes as follows. As shown in FIG. 1, the latching-ejector units 16, 18 are intended to be mounted onto opposite ends of the receptacle housing 12, with the resilient leg members 46, 48 outside the sidewalls 22, 24 respectively, and with each stud 52 snapped into a corresponding one of the apertures 36, 38. It will be readily appreciated from FIGS. 1, 3, 4 and 5, that each aperture 36, 38 is shaped to accommodate a limited and reciprocal arcuate rotation of each stud 52 about the pivot end 58 thereof between an upper position (illustrated by FIG. 5) and a lower horizontal position (illustrated by FIGS. 1 and 3). It will also be appreciated that the W-shaped portion 50 and locking lip 66 accordingly swing toward or away from the plug housing 14 in response to the above mentioned rotation of the studs 52.

With the studs 52 in the upper position (shown by FIG. 5), and referring to FIGS. 1 and 3, the plug housing 14 is inserted laterally of its axis between the receptacle sidewalls 22, 24 and into the channel 20 where the bottom surface 44 of the plug housing engages the upper longitudinal side 56 of the studs 52. Further insertion rotates the studs 52 downward into the lower horizontal position and causes the W-shaped portion 50 to swing forward toward the inserted plug housing 14, with the lip 66 latching over the upper surface 42 to fasten the receptacle and plug housings together. At this point, the receptacle and plug contacts are in mating electrical engagement shown in FIG. 3. It should be noted that the latching-ejector units lock automatically with the insertion of the plug housing into the channel.

Sequential unlocking and ejecting separation of the housings 12, 14 is illustrated by FIGS. 3, 4, and 5. To unlatch each lip 66 from the upper surface 42 of the plug housing 14, outward manual pressure is applied to the grooved surface 68 of each cantilever finger 60 by the first digit of one hand. This causes the cantilever finger to resiliently flex away from the plug housing 14 to disengage the locking lip 66 therefrom. Further outward deflection of cantilever finger 60 establishes digital contact with the grooves 68 of the outer fingers 62, 64, and still further deflection effectuates unitary outwardly swinging rotation of the W-shaped portion 50 downward, which causes upward rotation of the studs 52 about the pivot end 58 thereof. Upward rotation of the studs 52 forces the plug housing upward out of mating relationship with the receptacle housing 12, and causes the contacts in the housings to electrically disengage. It should be appreciated that the unlocking and ejecting separation of the housings 12, 14 must always occur in the proper sequence since both result from one common actuation motion. Also, it should be noted that the plug and receptacle housings can jointly function independent of the presence, or absence, of the latching-ejector units intended to be used therewith.

While the above description of the preferred embodiment exemplifies the principles of the subject invention, other embodiments which will be apparent to one skilled in the art and which utilize the teachings herein set forth are intended to be within the scope and spirit of the subject invention.

What is claimed is:

1. In combination with a connector receptacle housing having a channel defined by a base and parallel sidewalls and at least two profiled apertures in opposing sidewalls, and with an elongate plug housing adapted for lateral insertion between the receptacle sidewalls into the channel and into mating relationship with the receptacle housing:

at least one latching-ejector device comprising at least one generally U-shaped rocker member having two parallel and spaced apart leg members depending from bight means into straddling engagement with the receptacle housing outside of the receptacle sidewalls, and each leg member having a transversely elongate stud extension at a distal end thereof directed inwardly through a respective one of said apertures to engagingly support a bottom surface of the plug housing along an upper elongate side of said stud extension, and said bight means having a latching projection directed toward and into latching engagement over an upper surface of the plug housing to latch the plug and receptacle housings together in said mating relationship.

2. The latching-ejector device as set forth in claim 1, wherein each said stud extension is upwardly rotatable about one end thereof in said respective aperture in response to outward swinging rotation of said bight means away from the plug housing, whereby upon swinging movement of said bight means away from the plug housing, said latching projection disengages from said upper surface and said stud extensions rotate upwardly about respective said one ends to influence the plug housing upward in the receptacle channel and out of said mating relationship.

3. The latching-ejector devices as set forth in claim 2, wherein said bight means comprises a W-shaped portion having two outer fingers each integral with a respective one of said leg members at an end opposite of said distal end of said respective leg members, and said W-shaped portion having a central resilient finger integrally disposed between and in advance of said outer fingers toward the plug housing, and said latching projections being integral with said central finger, whereby outwardly directed pressure against said central finger flexes said finger outward and away from said plug housing and into axially adjacent and coplanar alignment with said outer fingers, and further outwardly directed pressure against all three of said fingers initiates said upward rotation of said stud extensions.

4. A self-locking electrical connector assembly comprising:

elongate housing receptacle means having two spaced apart parallel sidewalls and a base portion defining an elongate channel therebetween externally accessible along an upper longitudinal length of said channel, each said sidewall having two apertures of predetermined configuration formed therein, with each said aperture being proximate an alternate respective end of said sidewall and opposite a complimentary aperture of the other said sidewall;

elongate housing plug means configured and shaped for close insertion laterally of its axis between said sidewalls of said housing receptacle means and downward into said channel a prescribed distance, and said housing plug means having upper surface means;

latching-ejector means comprising a pair of generally U-shaped rocker members, each rocker member having two resilient cantilever arms extending parallel and spaced apart from a central bight portion, with lower ends of said cantilever arms straddling a respective end of said housing receptacle means outside of said sidewalls, and each said lower end having an inwardly directed camming projection of elongate section extending through a corresponding said aperture and into said channel, said bight portion of each said rocker member having a latching projection extending inwardly toward said inserted housing plug means fixedly parallel to respective said camming projections, and each said camming projection being downwardly rotatable about one end thereof as said housing means is inserted into said channel and into peripheral engagement with upper surfaces of said camming projections, whereby upon said downward arcuate movement of said camming projections, said bight portion swings forward on said cantilever arms toward said housing plug means and said latching projection engages over said upper surface means to latch said housing plug and receptacle means together.

5. An assembly as set forth in claim 4, wherein said bight portion of each said rocker member comprises a W-shaped portion having two outer fingers each integral with a respective one of said cantilever arms at an end opposite said lower end, and integral with a central resilient cantilever finger disposed therebetween and in advance thereof toward said housing plug means, said locking projection being integral with said central resilient finger, whereby outward pressure against said central resilient finger rotatably flexes said central finger outward and away from said housing plug means and into coplanar alignment with said outer fingers to disengage said locking projection from said upper surface means, and upon further outward unitary rotational movement of said central finger and said outer fingers about respective camming projections, said camming projections rotate upwardly within said apertures about respective said one ends to influence said housing plug means upward and out of mating relationship with said housing receptacle means.

6. An assembly as set forth in claim 5, said housing receptacle means further comprising first contact means secured within said base portion, and said housing plug means having second contact means for matably engaging said first contact means as said housing plug means is inserted into said channel the prescribed distance, and for disengaging from said first contact means as said housing plug and receptacle means are ejected out of said mating relationship.

* * * * *